US005826554A

United States Patent [19]

Kühnel et al.

[11] Patent Number: 5,826,554

[45] Date of Patent: Oct. 27, 1998

[54] PRESSURE RELIEF MEANS FOR A THIN WALL, AIR INTAKE PIPE FOR AN INTERNAL COMBUSTION ENGINE

[75] Inventors: Hans-Ulrich Kühnel, Mönchengladbach; Franz Dellen, Willich, both of Germany

[73] Assignee: Pierburg AG, Neuss, Germany

[21] Appl. No.: 884,521

[22] Filed: Jun. 27, 1997

[30] Foreign Application Priority Data

Jun. 27, 1996 [DE] Germany ..... 196 25 768.9

[51] Int. Cl.[6] ..... F02P 5/10; F02B 75/26

[52] U.S. Cl. ..... 123/184.54; 123/198 D

[58] Field of Search ..... 123/184.53, 184.54, 123/184.21, 198 D

[56] References Cited

U.S. PATENT DOCUMENTS

| | | | |
|---|---|---|---|
| 1,677,019 | 7/1928 | Casati et al. | 123/198 D |
| 3,678,912 | 7/1972 | Hensler | 123/198 D |
| 4,499,916 | 2/1985 | Hanson et al. | 137/103 |
| 4,538,555 | 9/1985 | Kite | 123/184.47 |
| 4,986,225 | 1/1991 | Wu et al. | 123/184.54 |
| 4,991,547 | 2/1991 | Davis et al. | 123/184.54 |
| 5,018,486 | 5/1991 | Davis et al. | 123/184.54 |
| 5,129,426 | 7/1992 | Boehmer | 137/854 |
| 5,280,769 | 1/1994 | Yates | 123/184.54 |
| 5,375,565 | 12/1994 | Maxson et al. | 123/198 D |
| 5,507,256 | 4/1996 | Czedzeck | 123/184.53 |

FOREIGN PATENT DOCUMENTS 2526550 12/1976 Germany .

*Primary Examiner*—David A. Okonsky
*Attorney, Agent, or Firm*—Ladas & Parry

[57] ABSTRACT

A valve is installed in an opening provided in a thin wall of an air intake pipe, which supplies combustion air from a flow control device to a cylinder of an internal combustion engine, to relieve excess pressure in the pipe. The valve includes a socket connected to a segment of the air intake pipe, and an elastomer, umbrella valve member is supported in the socket to normally cover the opening in the pipe and to undergo deformation when the pressure in the pipe reaches a predetermined value to uncover the opening and to connect the interior of the pipe to the ambient atmosphere.

9 Claims, 1 Drawing Sheet

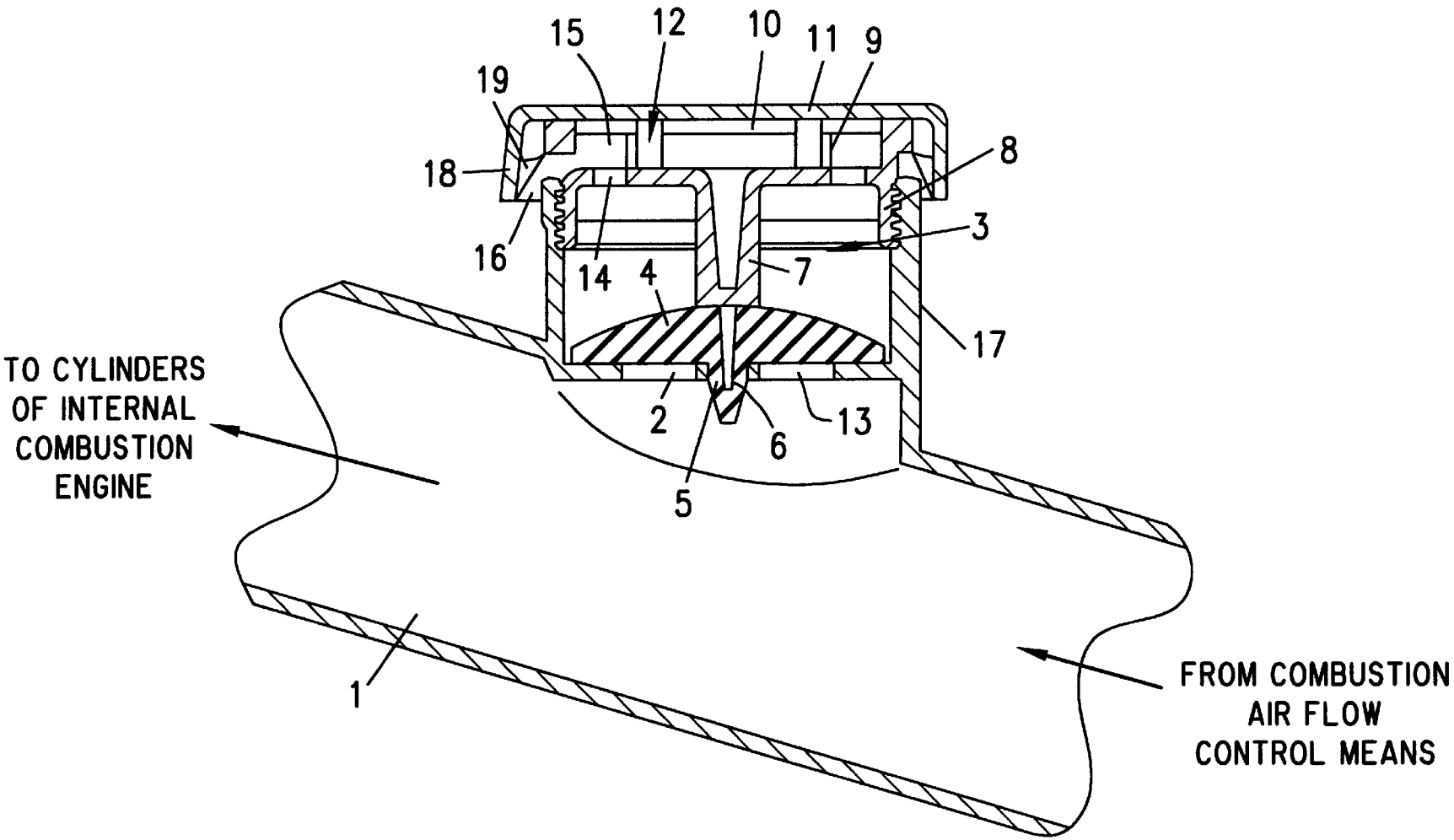
FROM COMBUSTION AIR FLOW CONTROL MEANS
TO CYLINDERS OF INTERNAL COMBUSTION ENGINE
1
2
3
4
5
6
7
8
9
10
11
12
13
14
15
16
17
18
19

PRESSURE RELIEF MEANS FOR A THIN WALL, AIR INTAKE PIPE FOR AN INTERNAL COMBUSTION ENGINE

FIELD OF THE INVENTION

The invention relates to a thin wall, air intake pipe for conveying combustion air from a throttle valve to the cylinders of an internal combustion engine and particularly to pressure relief means for said intake pipe.

BACKGROUND

Air intake pipes having increasingly thinner walls and lighter weight are finding wider use, since they can be easily shaped and therefore adapted to various configurations. The pipes can be made from metal or plastic materials.

However, it has been found, in the automotive field in which such pipes are utilized, that pipes have burst after starting the internal combustion engine.

Therefore, the weakness of the thin wall pipes must be compensated by suitable means.

SUMMARY OF THE INVENTION

An object of the invention is to provide a thin wall air intake pipe of the above type which incorporates means to compensate for its lack of strength to prevent bursting of the pipe.

The above and further objects of the invention are satisfied by providing an opening in a segment of the thin wall of the air intake pipe and installing valve means in said opening which includes a valve member, responsive to pressure in the air intake pipe to open said valve means and provide connection of the interior of said air intake pipe to the ambient atmosphere when the pressure in the air intake pipe reaches a predetermined value.

In accordance with a particular embodiment of the invention, the valve means comprises a socket engaged with the pipe segment by a threaded connection and supporting said valve member.

In a preferred embodiment, the valve member is constituted as an elastomer, umbrella valve whose central portion is held down by a finger on the socket and whose surrounding, perimetral portion covers the opening in the wall of the air intake pipe.

In further accordance with the invention, the socket has a top wall with openings to allow escape of the gases from the interior of the air intake pipe to the ambient atmosphere to relieve the pressure in the air intake pipe when the pressure reaches the predetermined value and the valve member opens the opening in the air intake pipe.

In further accordance with the invention, a cover is snap fit on the socket to cover the openings in the top wall.

BRIEF DESCRIPTION OF THE DRAWING

The sole FIGURE of the drawing is a longitudinal sectional view through a segment of an air intake pipe containing a valve according to the invention.

DETAILED DESCRIPTION OF A PREFERRED EMBODIMENT

The drawing shows a segment 1 of an air intake pipe which conveys combustion air from an upstream air flow control means, such as a throttle valve, to one of the cylinders of an internal combustion engine lying downstream of the air flow control means. The air intake pipe has a thin wall and is made of metal or plastic.

In accordance with the invention, the wall of pipe segment 1 is provided with an annular opening 2 having spaced, radial dividing ribs 13, and a valve 3 is installed on the pipe segment 1 to control outflow of gases in the interior of the pipe segment when the pressure of said gases exceeds a predetermined value.

The valve 3 includes a valve member 4 in the form of a so-called umbrella valve made of an elastomer material. The umbrella valve 4 has a depending central stem 5 which is engaged in a hole 6 in the wall of the pipe segment 1 and the umbrella valve 4 is pressed from above in its central region by a retaining finger 7 of a socket 8 which threadably engages a tubular wall 17 on the pipe segment 1. Although the wall 17 is shown as integrally formed with the wall of the pipe segment 1, it is also within the scope of the invention to include wall 17 in a separate assembly which is sealingly secured to the pipe segment around a hole formed in the wall of the pipe. A peripheral region of valve member 4 surrounding the retaining finger 7 covers the opening 2 and is subjected to the pressure of the gases in the interior of the pipe segment and is deformed to uncover the opening 2 when the pressure of the gases in the pipe exceeds said predetermined value.

The socket 8 has a top wall provided with openings 14, the retaining finger 7 depending centrally from the top wall. A perimetral wall of the socket 8 is threadably engaged with wall 17. A plurality of integral ribs 9 are formed on the top surface of the top wall of socket 8 and a collar ring 10 is integrally connected to upper ends of the ribs 9. The ribs 9 are manually engageable to serve as a means 12 for turning the socket 8 to threadably engage the socket 8 with the wall 17.

A cover 11 is elastically engaged on the socket 8 by means of a snap-fit connection formed by hooks 19 on the inner periphery of wall 18 of cover 11 which snap-engage the underside of a recess formed in the ribs 9. The cover 11 prevents dirt and water from entering pipe segment 1 through the valve 3.

The invention is based on the discovery that bursting of the air intake pipe 1 is caused by an explosive ignition of fuel and air-fuel residues, stored or condensed in the air intake pipe 1 mixed with the air contained in the air intake pipe 1. The explosive ignition occurs suddenly when the internal combustion engine is started. In particular, a flame-pressure wave is produced in the air intake pipe which cannot escape to the ambient atmosphere when the engine is started and is idling and the throttle valve of the flow control means is closed. Consequently, a rapid increase in pressure is developed in the air intake pipe which can lead to its damage or destruction.

In accordance with the invention, such pressure rise is limited by the valve 3 which opens when the pressure reaches a predetermined value to release the combustion gas to the ambient atmosphere.

The combustion gas escapes from pipe segment 1 through opening 2 when the valve member 4 uncovers the opening 2, the combustion gas flowing through openings 14 in the top wall of the socket 8 and through openings 15 between the ribs 9 into an annular gap 16, formed between the inner surface of wall 18 of cap 11 and the outer surface of wall 17, and then into the ambient atmosphere.

Although the invention has been described in relation to a specific embodiment thereof, it will become apparent to those skilled in the art that numerous modifications and variations can be made within the scope and spirit of the invention as defined by the attached claims.

What is claimed is:

1. A thin wall air intake pipe for supplying combustion air from a flow control means to a cylinder of an internal combustion engine, said air intake pipe comprising a segment having an opening therein and a valve means in said opening including a valve member responsive to pressure in the air intake pipe to open said valve means and provide connection of said air intake pipe to ambient atmosphere when the pressure in the air intake pipe reaches a predetermined value, said valve means comprising a socket connected to said segment of said air intake pipe, said valve member comprising an elastomer, umbrella valve including a central stem engaged in said segment of said pipe, said socket including a retaining finger engaging said umbrella valve to hold the stem in said segment of the pipe.

2. An air intake pipe as claimed in claim 1, comprising a threaded connection between said socket and said segment of said pipe.

3. An air intake pipe as claimed in claim 1, wherein said umbrella valve faces said opening in the segment of said pipe and normally covers said opening, said umbrella valve being deformed when said pressure in the air intake pipe reaches said predetermined value.

4. An air intake pipe as claimed in claim 3, wherein said umbrella valve has a resilient region around said stem which is deformed when the pressure in the air intake pipe reaches said predetermined value to uncover said opening in the air intake pipe.

5. An air intake pipe as claimed in claim 3, wherein said socket has outlet openings communicating with the ambient atmosphere and connected to the opening in the segment in the air intake pipe when said valve means is opened, and a cover provided on said socket.

6. An air intake pipe as claimed in claim 5, comprising a snap-engagement means between said cover and said socket.

7. An air intake pipe as claimed in claim 5, wherein said socket includes a top wall from which said finger depends, said top wall having openings in communication with said outlet openings.

8. An air intake pipe as claimed in claim 7, comprising ribs on said top wall of said socket forming manual engagement means for turning said socket to threadably engage the socket and the segment of the air intake pipe.

9. An air intake pipe as claimed in claim 8, comprising a tubular wall on said segment of the air intake pipe which threadably receives said socket.

* * * * *